US005803830A

United States Patent [19]

Austin et al.

[11] Patent Number: 5,803,830

[45] Date of Patent: Sep. 8, 1998

[54] OPTIMUM DYNAMIC IMPACT GOLF CLUBS

[76] Inventors: Michael Hoke Austin, 5446 Irondale Ave., Woodland Hills, Calif. 91367; Arthur Sydney Forster, 3434 Shoreheights Dr., Malibu, Calif. 91265

[21] Appl. No.: 286,374

[22] Filed: Aug. 1, 1994

[51] Int. Cl.[6] ..... A63B 53/04

[52] U.S. Cl. ..... 473/328; 473/334; 473/337; 473/333; 473/339

[58] Field of Search ..... 273/167 H, 167 F, 273/173, 167 E, 167 A, 174; 473/324, 333, 335, 334, 337, 328

[56] References Cited

U.S. PATENT DOCUMENTS 1,665,525 4/1928 Boyce ..... 273/173
4,319,752 3/1982 Thompson ..... 273/167 H
5,203,565 4/1993 Murray et al. ..... 273/167 E
5,271,622 12/1993 Rogerson ..... 273/167 E

*Primary Examiner*—Aaron J. Lewis
*Assistant Examiner*—Charles W. Anderson

[57] ABSTRACT

Non-conventional clubhead designs for driver, fairway clubs (woods), irons, and putter type golf clubs wherein the maximum (optimized) clubhead mass and centralized balance/momentum control mechanism are coincident with the clubhead center of percussion improved efficacy in the angular of momentum exchange between golf club and ball at impact, and optimum flight trajectory, distance, accuracy, and control. Additional non-conventional design features of the driver and fairway clubs (woods) include a low drag aerodynamic profile, fully-active double curvature aerodynamic wing, integral impact shock/vibratory damping, a double curvature faceplate that is insensitive to fracture and cave-in, and a highly contoured soleplate for up-hill and down-hill lies.

24 Claims, 9 Drawing Sheets

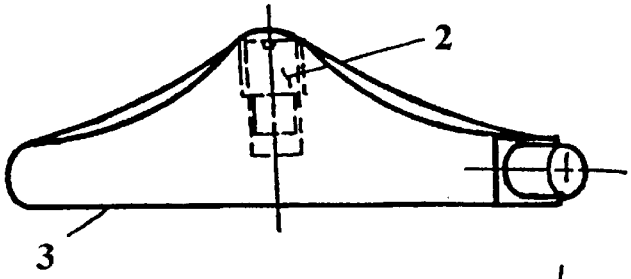
FIG. 7
FIG. 8
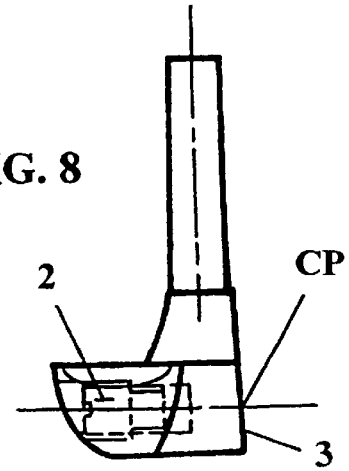
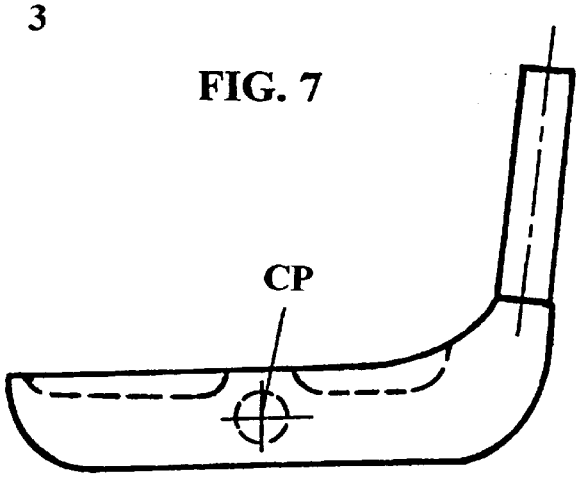
FIG. 6
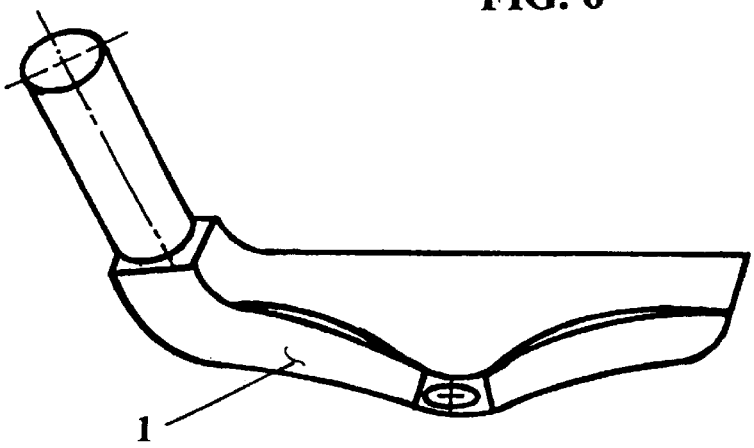
FIG. 5

FIG. 9
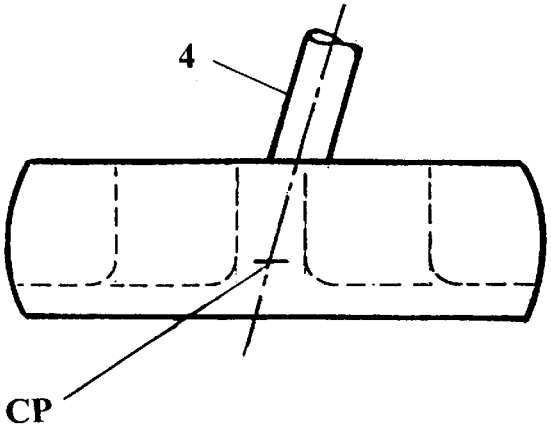
FIG. 10
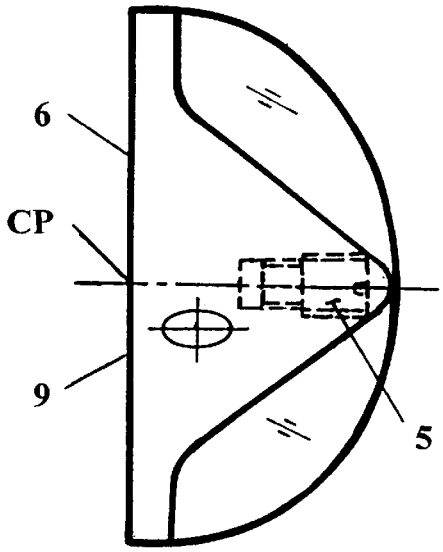
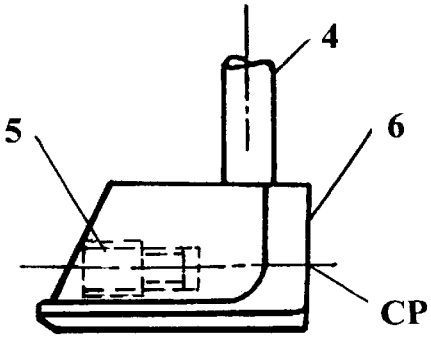
FIG. 11
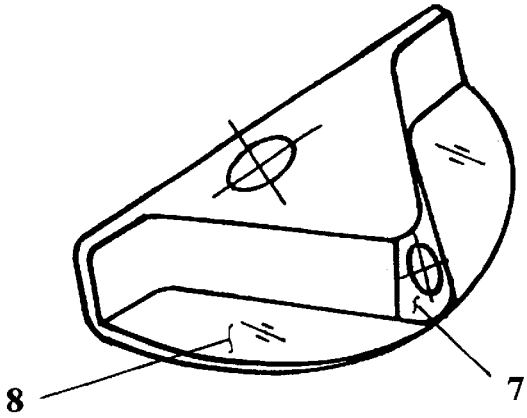
FIG. 12

FIG. 20
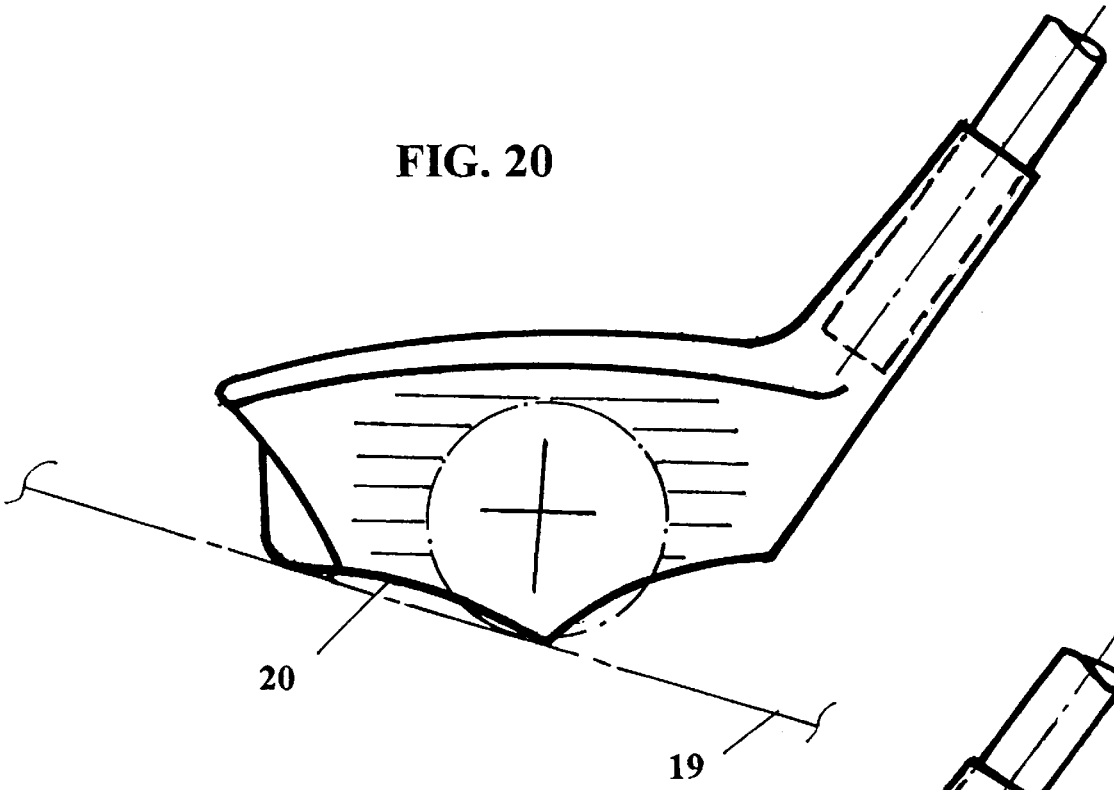
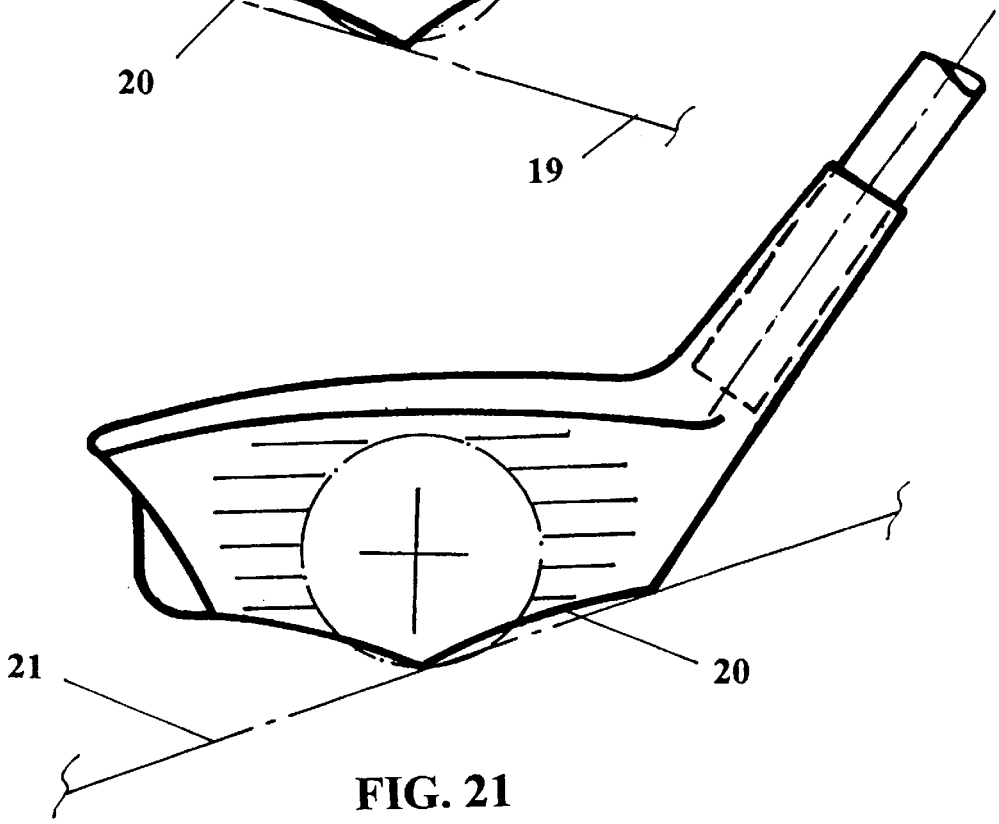
FIG. 21

FIG. 22
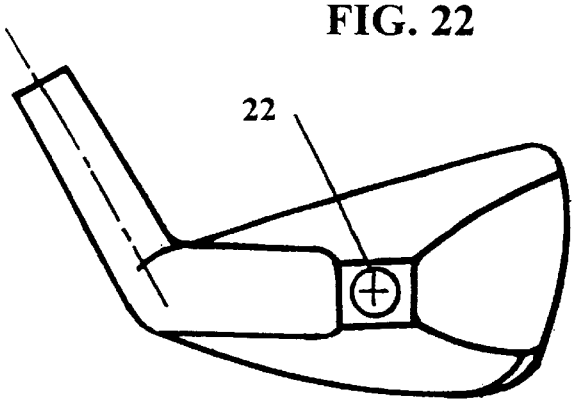
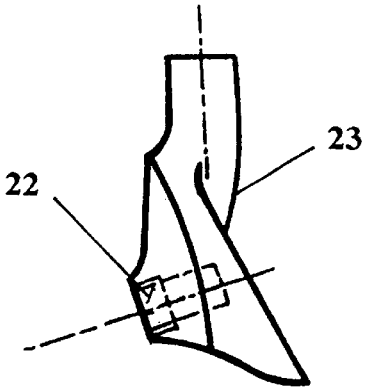
FIG. 24
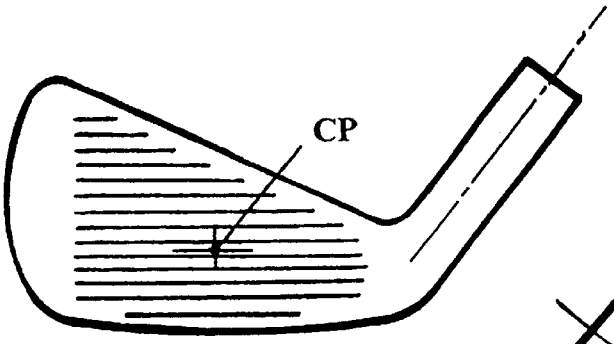
FIG. 23
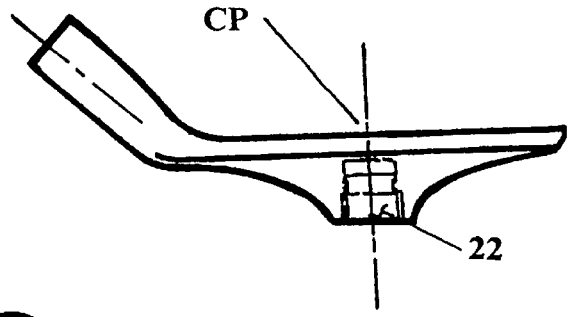
FIG. 25
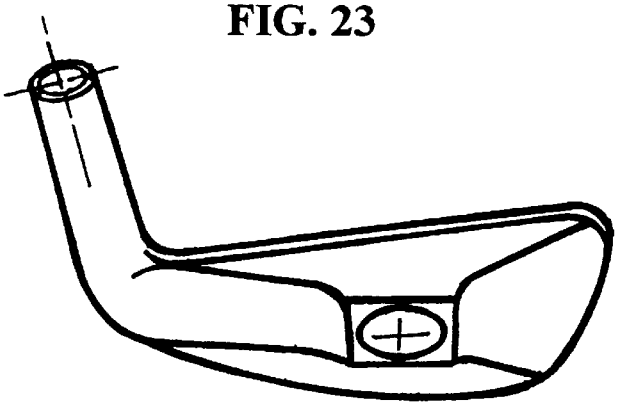
FIG. 26

FIG. 28
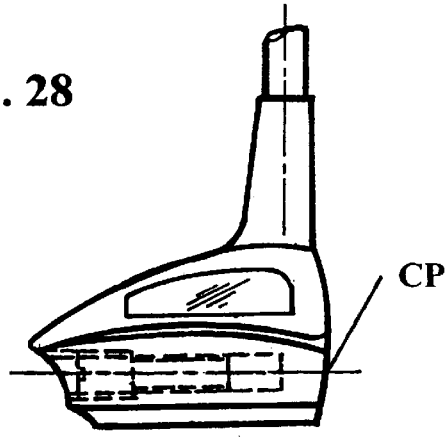
FIG. 29
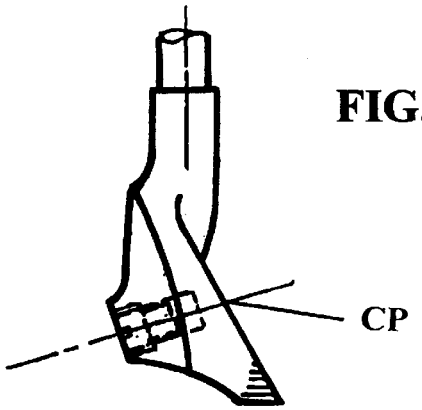
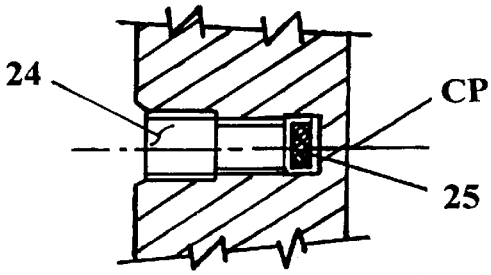
FIG. 27
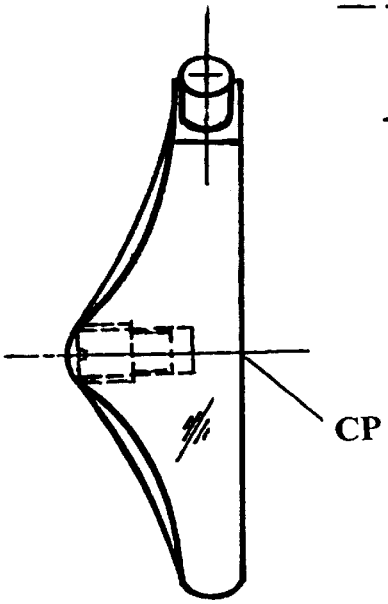
FIG. 31
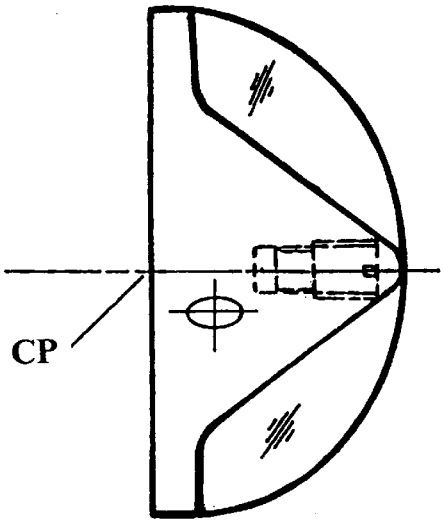
FIG. 30

OPTIMUM DYNAMIC IMPACT GOLF CLUBS

BACKGROUND AND BRIEF DESCRIPTION OF THE INVENTION

The present invention is distinctly different from all prior art concepts for golf clubs, these differences include the invention's analytical design philosophy, the application and integration of fundamental physics and advanced engineering principles, and the integration of proven high-tech manufacturing/construction processes. These differences are new, revolutionary, and represent major break-throughs in the design, manufacture, control, and playability of golf clubs.

The present invention relates to all golf clubs (driver, fairway clubs, irons, and putter) and maximizes (optimizes) the magnitude and efficacy of angular momentum exchange between the rotating club and stationary ball at impact; optimimzes flight trajectory, distance, accuracy, and control; and maximizes the efficacy of off-center hits that are not coincident with the center of percussion. More particularly the invention optimizes, in accordance with the clubs strength and stiffness criteria, the maximum clubface mass that may be located coincident with the center of percussion mass for maximum attainable exchange of momentum efficacy; optimizes clubhead mass distribution profiles from the center of percussion to maximize the efficacy (expanded "effective" sweetspot) of off-center hits that are not coincident with the center of percussion; and provides an integral centralized balance/control mechanism that is strategically located on the rear face of the clubhead (all types) and coincident with the respective clubhead(s) center of percussion.

The prior art that relates to this invention shows two dissimilar designs that attempt to: (a) minimize the effects of off-center impacts, and (b) acquire optimum trajectory, distance, control, and accuracy. The first is the conventional perimeter weighted golf club design philosophy. The second is the Nicklaus linear dynamic golf club design philosophy. These will each be discussed.

a).—CONVENTIONAL PERIMETER WEIGHTED DRIVERS, FAIRWAY CLUBS (WOODS), & IRONS

Conventional perimeter weighted drivers and fairway clubs (woods) have essentially identical clubhead geometric configurations, principle differences include volumetric size, clubface loft angle, and shaft lie angle. Alternate methods of construction include: (1) hollow metal shell with increased structural mass distributed around the perimeter, the faceplate (thin diaphragm) is attached to the perimeter and supported by non-structural foam that fills the hollow shell cavity, and (2) hollow non-metallic shell with internal bracing and increased structural mass distributed around the perimeter, the faceplate (thin diaphragm) is attached to the perimeter and supported by non-structural foam that fills the internal cavities. The conventional perimeter weighted or so-called cavity backed irons are similarly in construction; the faceplate (thin diaphragm) is supported by an increased mass perimeter; the faceplate is otherwise unsupported. Conceptionally the perimeter weighted clubs provide an "enlarged sweetspot" to minimize off-center hits and the perimeter weighted structure increased torsional stability. The term "larger sweetspot" is misleading and inaccurate. The "sweetspot" of a clubhead is simply the clubhead's center of percussion and as such cannot be moved or enlarged, and off-center hits incur loss of distance, trajectory, and accuracy. Tests comparing the torsional stability of standard, mid-size, and jumbo perimeter weighted clubs have indicted insignificant differences. Perimeter weighted clubs are highly susceptible to clubface fracture and cave-in, inherent marginal moments of inherent, and stress discontinuites. The non-optimum mass distribution profile of the clubs, clubface sensitivity to incurred deflections and angular momentum exchange characteristics are inconsistent with optimum trajectory, control, distance and accuracy.

The Nicklaus linear dynamic golf club driver and fairway clubs (woods) clubheads are perimeter weighted hollow metal shells filled with non-structural foam, structural stabilizing bars integral with the soleplate redistribute mass either side of the hitting area. The linear dynamic irons are conventional in configuration, vertical stabilizing bars located at the toe and heel sections and an horizontal stabilizing bar is attached to the two vertical bars, significant area of clubface is unsupported between the upper leading edge of the clubface and the horizontal bar. Conceptionally the horizontal bar is strategically located behind the impact area for optimum trajectory and control, and vertical bars either side of the impact zone to reduce twist of off-center hits. The non-optimum mass distribution profile of the driver, fairway clubs (woods), and irons is inconsistent with the development of optimum trajectory, control, and distance.

Clarification of the design philosophies dissimilarities and radical differences in the functional efficacy of the present invention—Optimum Dynamic Impact golf clubs and prior art—Perimeter Weighted/Linear Dynamic golf club design concepts is evident from a simplistic comparison that is analogous to comparing the efficacy of striking a nail with a hammer (Optimum Dynamic Impact Club with concentrated mass) or with a large thin perimeter supported diaphragm (Perimeter Weighted/Linear Dynamic Clubs with distributed mass), differences in the efficacy of applied impulse to the nail are readily apparent.

More specifically the radical differences in the design philosophies of the present invention—Optimum Dynamic Impact golf clubs and prior art, is the present invention's innovated advanced integrated system design methodology compared to the elemental "piecemeal" approach of existing state-of-the art designs. It is important to note in evaluating the present invention's integration of the centralized balance/control mechanism, integral damping, and maximum clubhead mass at the clubhead(s) center of percussion, that the density of the varible-length centralized balance/control setscrew that locates and retains the vernier balance mass wafers within the clubheads is approximately 250%–900% higher than the basic material being displaced. This innovated technique provides this increase in mass at the clubhead center of percussion and significantly increases the magnitude and efficacy of applied impulse to the golf ball.

The preferred all-metal driver and fairway clubs (woods) configuration of the present invention with integral damping and centralized balance/momentum control has other innovative features that are fully functional and test proven; these test proven features include a low drag profile, a fully active double curvature upper surface aerodynamic wing, distinctive blending of body and upper surface aerodynamic wing for improved airflow characteristics, double curvature faceplate that is insensitive to fracture and cave-in, and highly contoured soleplate for up-hill and down-hill lies.

The golf club irons and putter types of the present invention are radically different and superior to prior art concepts. The present invention design philosophy is applied to both the irons and putter types—maximum (optimum) clubhead mass and centralized balance/control mechanism are located on the rear face of each club and coincident with their respective center of percussion, and computerized mass distribution profiles from the center of percussion to maximize the efficacy (expanded "effective" sweetspot) of off-center hits that are not coincident with the center of percussion, for optimum flight trajectory, distance, control, and accuracy. The present invention irons and putter have outstanding structural integrity, inherently high moments of inertia, and are insensitive to the stress discontinuities, strength, and deflection problems of the prior art concept It is generally understood that both the foregoing general description and following detailed description are exemplary and explanatory only and are not restrictive of the invention as claimed.

The accompanying drawings, which are incorporated in and constitute a part of this specification, illustrate the invention and together with the description serve to explain the principles of the invention.

BRIEF DESCRIPTION OF DRAWINGS (a) Drawing 1/9—Optimum Dynamic Impact Golf Club Types—FIGS. 1–4.

(b) Drawing 2/9—Optimum Dynamic Impact Putter (Blade) Type Golf Club—FIGS. 5–8.

FIG. 5 Is an isometric view of the Optimum Dynamic Impact Putter (Blade) Type Golf Club from the rear.

FIG. 6 Is a front view thereof.

FIG. 7 Is a plan view thereof.

FIG. 8 Is an end view thereof.

(c) Drawing 3/9—Optimum Dynamic Impact Putter (Mallet) Type Golf Club—FIGS. 9–12.

FIG. 9 Is a front view of the Optimum Dynamic Impact Putter (Mallet) Type Golf Club.

FIG. 10 Is a plan view thereof.

FIG. 11 Is a end view thereof.

FIG. 12 Is an isometric view thereof from the rear.

Figure 15:
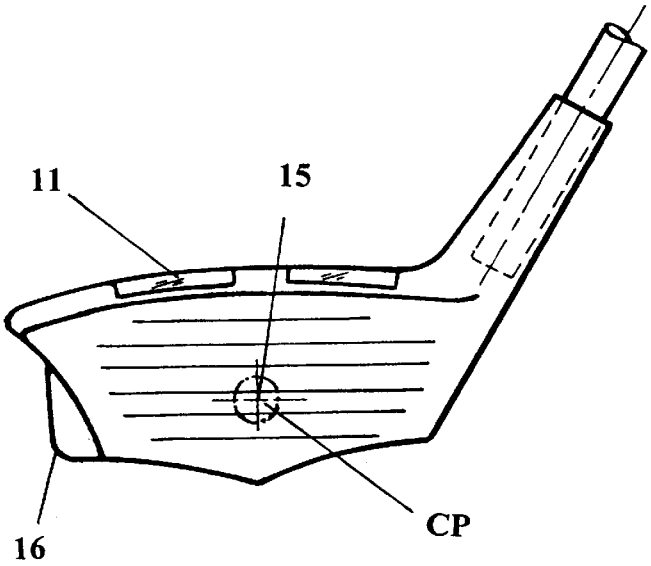
Figure 14:
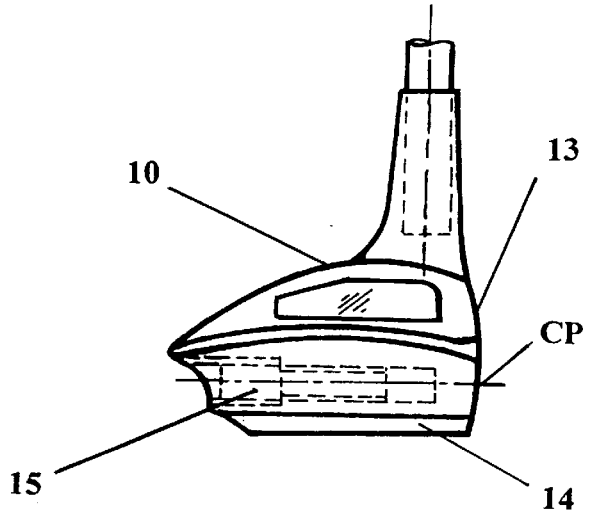
Figure 13:
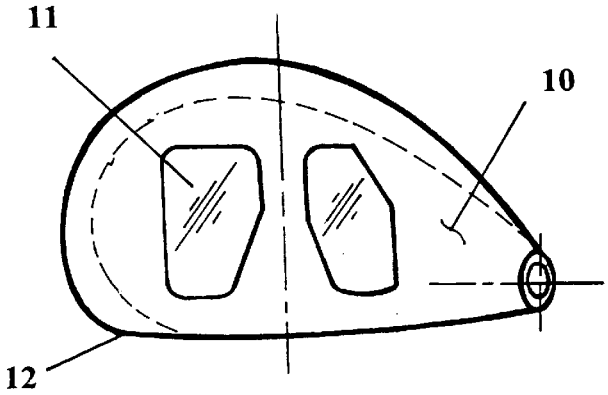

(d) Drawing 4/9—Optimum Dynamic Impact Driver/Fairway Clubs (Woods) Type Golf Club—FIGS. 13–15.

FIG. 13 Is a plan view of the Optimum Dynamic Impact Driver/Fairway Clubs (Woods) Type Golf Club.

FIG. 14 Is an end view thereof.

FIG. 15 Is a front view thereof.

Figure 17:
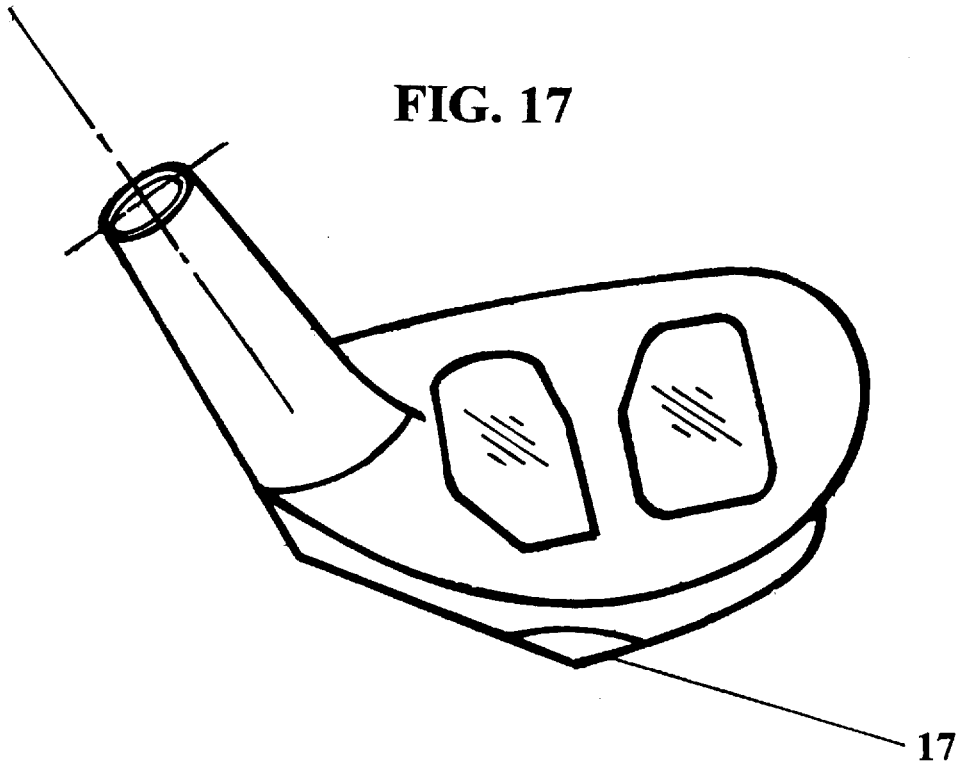
Figure 16:
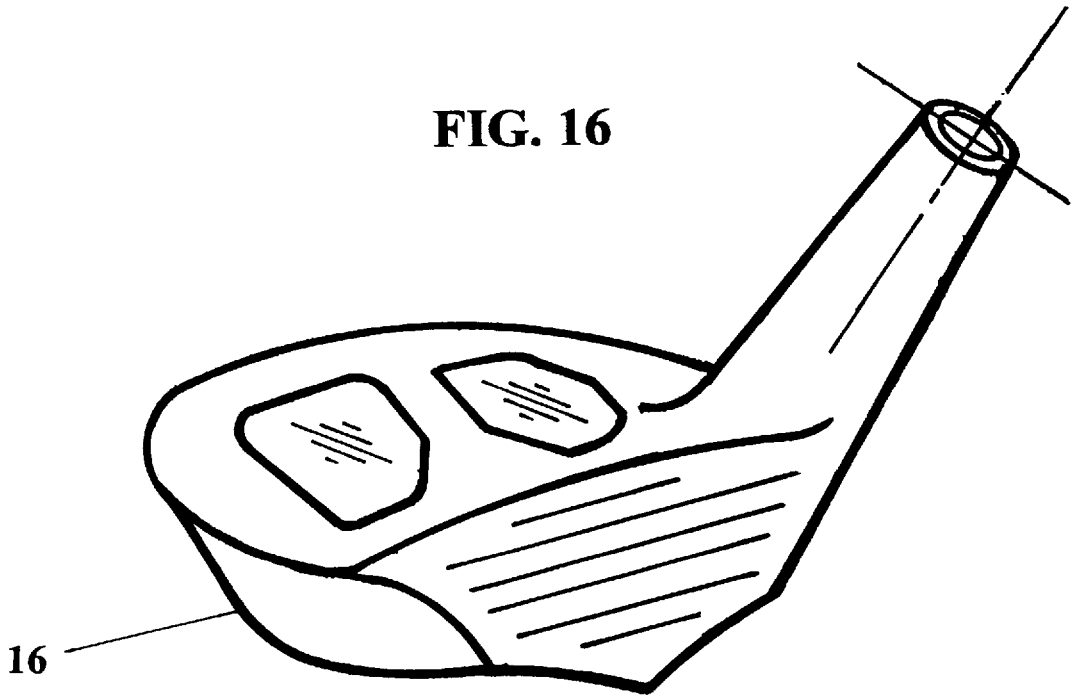

(e) Drawing 5/9—Optimum Dynamic Impact Driver/Fairway Clubs (Woods) Type Golf Clubs—FIGS. 16–17.

FIG. 16 Is an isometric view thereof from the front.

FIG. 17 Is an isometric view thereof from the rear.

Figure 18:
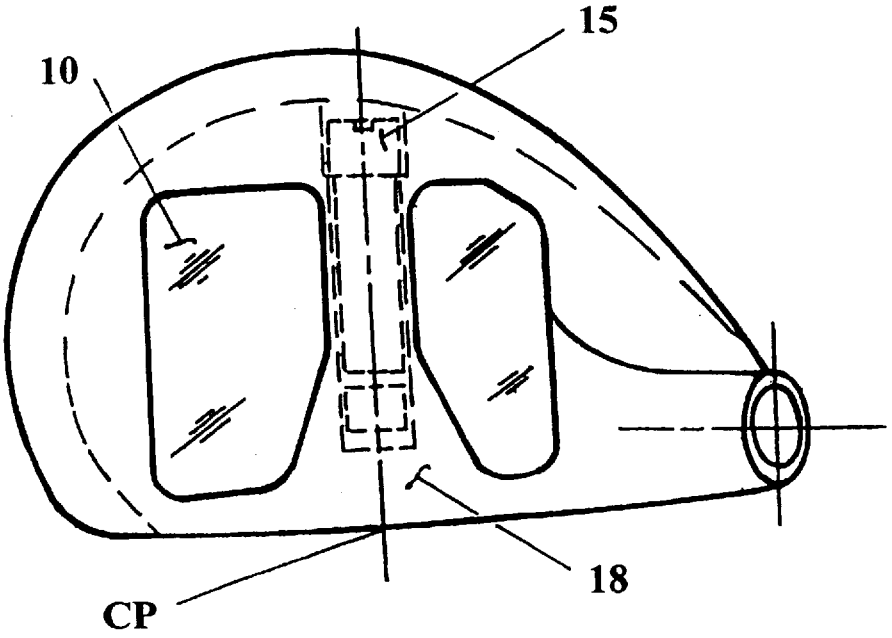
Figure 19:
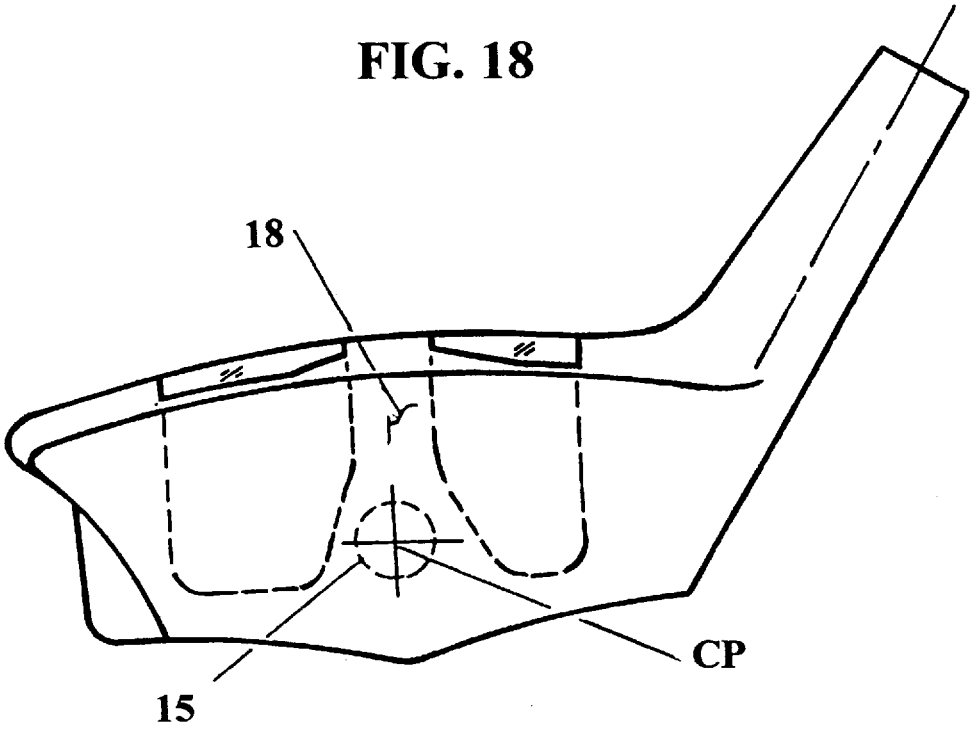

(f) Drawing 6/9—Optimum Dynamic Impact Driver/Fairway Clubs (Woods) Type Golf Club—FIGS. 18–19.

FIG. 18 Is detaled plan view thereof.

FIG. 19 Is a detailed front view thereof.

(g) Drawing 7/9—Optimum Dynamic Impact Driver/Fairway Clubs (Woods) Type Golf Club—FIGS. 20–21.

FIG. 20 Is a detailed front view thereof.

FIG. 21 Is a detailed front view thereof.

(h) Drawing 8/9—Optimum Dynamic Impact Iron Type Golf Club—FIGS. 22–26.

FIG. 22 Is a rear view of the Optimum Dynamic Impact Iron Type Golf Club

FIG. 23 Is a rear view thereof.

FIG. 24 Is an end view thereof.

FIG. 25 Is a plan view thereof.

FIG. 26 Is an isometric view thereof from the rear.

(i) Drawing 9/9—Optimum Dynamic Impact Golf Clubs Integral Centralized Balance/Control Mechanism(s)—FIGS. 27–31.

FIG. 27 Sectional plan view of Optimum Dynamic Impact Golf Clubs Integral Centralized Balance/Control Mechanism.

FIG. 28 Sectional view of Driver/Fairway Clubs (Woods) centralized balance/control mechanism.

FIG. 29 Sectional view of Iron Clubs centralized balance/control mechanism.

FIG. 30 Sectional view of Putter (Mallet Type) centralized balance/control mechanism.

FIG. 31 Sectional view of Putter (Blade Type) centralized balance/control mechanism.

DETAILED DESCRIPTION OF DRAWINGS

(a) Drawing 1/9—Optimum Dynamic Impact Golf Club Types—FIGS. 1–4.

FIGS. 1, 2, 3, & 4, illustrate the present invention four different types of golf clubs, the design of each club is consistent with the present invention —Optimum Dynamic Impact Golf Club design philosophy—maximum mass at center of percussion, optimized mass distribution profile to minimize effects of non-coincident center of percussion impacts, and integral centralized balance system for maximum attainable exchange of momentum efficacy, precise control, accuracy, flight trajectory, and club playability.

Figure 1:
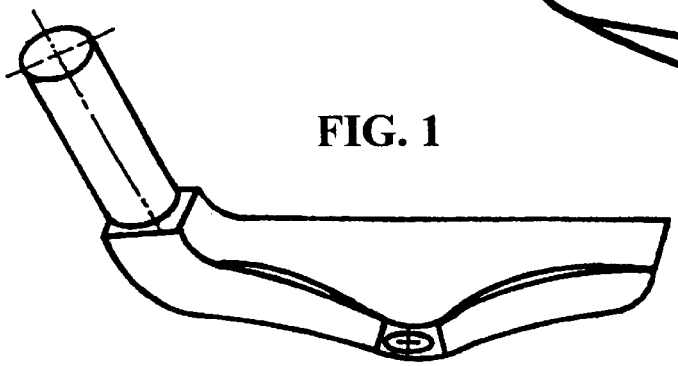
FIG. 1 Is an isometric view of the present invention—Optimum Dynamic Impact Putter (Blade) Type Golf Club.

FIG. 1.—Is an isometric view of the Optimum Dynamic Impact Putter (Blade) Type Golf Club from the rear.

Figure 2:
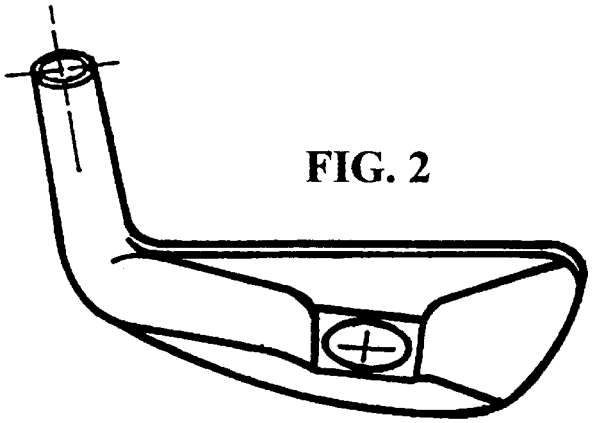
FIG. 2 Is an isometric view of the present invention—Optimum Dynamic Impact Iron Type Golf Club.

FIG. 2.—Is an isometric view of the Optimum Dynamic Impact Iron Type Golf Club from the rear.

Figure 3:
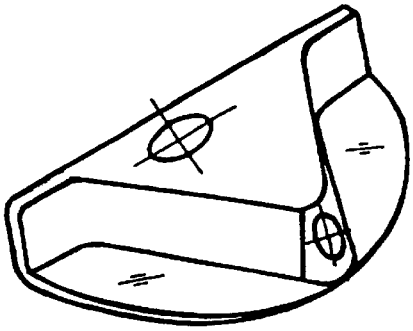
FIG. 3 Is an isometric view of the present invention—Optimum Dynamic Impact Putter (Mallet) Type Golf Club.

FIG. 3.—Is an isometric view of the Optimum Dynamic Impact Putter (Mallet) Type Golf Club from the rear.

Figure 4:
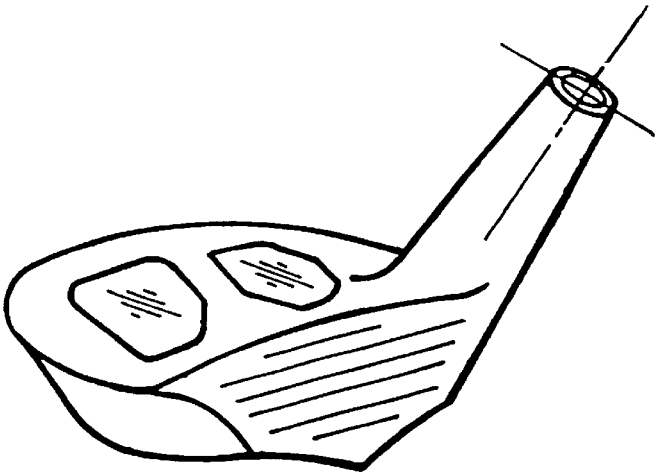
FIG. 4 Is an isometric view of the present invention—Optimum Dynamic Impact Driver/Fairway (Woods) Type Golf Club.

FIG. 4.—Is an isometric view of the Optimum Dynamic Impact Driver/Fairway (Woods) Type Golf Club.

(b) Drawing 2/9—Optimum Dynamic Impact Putter (Blade) Type Golf Club FIGS. 5–8.

The design of the putter is consistent with the basic Optimum Dynamic Impact golf club design philosophy—maximum mass at center of percussion, optimized mass distribution profile to minimize effects of non-coincident center of percussion hits, and integral centralized balance/control mechanism for maximum impact effects and precise micro-balance and control.

FIG. 5.—Is an isometric view that illustrates pictorially the concaved milled surfaces (1), the location of the optimized mass at the center of percussion, and the overall physical configuration of the putter.

FIG. 6.—Is a frontal view of the putter that pictorially illustrates the basic configuration, concentration of mass at the clubhead center of percussion (CP), and the location of the highly sensitive centralized balance/control mechanism.

FIG. 7.—Is a plan view of the putter that illustrates the computerized mass distribution profile and concentration of optimized mass at the center of percussion, the centralized balance/control mechanism (2), the straight milled ball striking surface (3), and the contoured milled shape of the rear section. The centralized balance/control vernier balance mass wafers have been omitted for clarity. Vernier balance mass wafers are illustrated in FIG. 27.

FIG. 8.—Is an end view of the putter that illustrates the straight flat milled ball striking surface (3) of the putter and its small negative inclination angle, centralized balance/control mechanism (2), and clubhead center of percussion (CP).

(c) Drawing 3/9—Optimum Dynamic Impact Putter (Mallet) Type Golf Club FIGS. 9–12.

The design of the putter is consistent with the basic Optimum Dynamic Impact Golf Club design philosophy—maximum mass at the center of percussion, optimized mass distribution profile to minimize the effects of non-coincident center of percussion hits, and integral centralized balance/control mechanism for maximum impact effects and precise micro-balance and control.

FIG. 9.—Is a frontal view of the putter that pictorially illustrates the basic configuration, concentration of mass at the clubhead center of percussion (CP), and centralized location of shaft (4).

FIG. 10.—Is a plan view of the putter that illustrates the computerised mass distribution profile and concentration of optimized mass at the center of percussion (CP), the centralized balance/control mechanism (5), the straight flat milled ball striking surface (6), and the location of shaft receptable socket (9).

FIG. 11.—Is an end view of the putter that illustrates the straight flat milled ball striking surface (6) and its small negative inclination angle, centralized balance/control mechanism (5), clubhead center of percussion (CP), and shaft (4) location. The centralized balance/control vernier balance mas wafers have been omitted for clarity—See FIG. 27.

FIG. 12.—Is an isometric view that illustrates pictorially the triangular shape of the concentrated mass and the location of apex (7), configuration of soleplate (8), and overall configuration.

(d) Drawing 4/9—Optimum Dynamic Impact Driver/Fairway Clubs (Woods) Type Golf Clubs—FIGS. 13–15.

The design of the driver and fairway clubs are consistent with the basic Optimum Impact (Impulse) Dynamic golf club design philosophy—maximum mass at center of percussion, optimized mass distribution profile to minimize effects of non-coincident center of percussion impacts, and integral centralized balance/control mechanism for precise control. Other unique design specific features of these clubs include preferred all-metal (magnesium or other low density material) construction, double curvature aerodynamic profile, integral non-metallic high damping impact shock/vibratory system, double curvature face for improved accuracy control, and unique sole design with a single low drag triangular rider and contoured heel and toe surfaces for improved playability of up-hill and down-hill lies. The double curvature upper surface profile functions as an active aerodynamic sail and as such elliminates airflow discontinuities, reduces drag, and increases downswing angular momentum of club and applied impulse to ball at impact.

FIG. 13.—Is a plan view of the club that illustrates the geometric shape and contour of the aerodynamic sail (10) and its extensive curved wing section extending beyond the body of the club, and the concentration of optimized mass at the center of percussion. Also indicated is the location and relative size of the two cavities that are filled with low density/high damping non-metallic material (11), and the bulge curvature of the clubface (12).

FIG. 14.—Is an end view of the club that illustrates the sweeping double curvature of the aerodynamic sail (10) and the overhang and curvature of the functional wing section, roll profile of clubface (13), single low drag triangular shaped sole rider (14), localized chamfer of the aft sole section, centralized balance/control mechanism (15), and clubhead center of percussion (CP). The centralized balance/control vernier balance mass wafers have been omitted for clarity. Vernier balance mass wafers are illustrated in FIG. 27.

FIG. 15.—Is a front view of the preferred all metal driver/fairway clubs that illustrates pictorially the highly effective aerodynamic profile, location and depth of the two cavities that are filled with low density/high damping non-metallic material (11), the geometric profile of the sole, centralized balance/control mechanism (15), center of percussion (CP), and toe portion of clubhead body (16). The horizontal control lines on the clubface are omitted for clarity.

(e) Drawing 5/9—Optimum Dynamic Impact Driver/Fairway Clubs (Woods) Type Golf Clubs—FIGS. 16–17.

FIG. 16.—Is an isometric frontal view that illustrates the toe portion of the clubhead body (16) extending beyond and smoothly transitioning into the club faceplate, lower surface of the aerodynamic wing and sole.

FIG. 17.—Is an isometric view of the back of the club that illustrates the sweeping contour of the aerodynamic sail, the location of cavities, and the geometric shape and localized chamfer of the sole and single rider (17).

(f) Drawing 6/9—Optimum Dynamic Impact Driver/Fairway Clubs (Woods) Type Golf Clubs—FIGS. 18–19.

FIG. 18.—Is a detailed plan view that illustrates the physical location and geometrical profile of the two shock/vibratory cavities (10) that are filled with low density high damping non-metallic material, a detailed view of the centralized balance/control mechanism (15), and the clubhead center of percussion (CP). The high density damping material and vernier balance mass wafers have been omitted for clarity.

FIG. 19.—Is an enlarged frontal view that illustrates the geometric profile of the two shock/vibratory cavities, and the geometric profile of the integral centralized structural member (18) that is optimized to maximize the impact mass at the clubhead center of percussion and house the centralized balance/control mechanism. The density of the centralized balance/control setscrew is approximately 900% higher than the preferred low density material of the clubhead body, this increase in setscrew density significantly increases the impact mass at the center of percussion.

(g) Drawing 7/9—Optimum Dynamic Impact Driver/Fairway Clubs (Woods) Type Golf Clubs—FIGS. 20–21.

FIG. 20.—Is a front view that illustrates an up-hill terrain (19), a golf ball, the innovated design features of the present invention clubhead soleplate that negates these difficult up-hill lies, and the single extremely low-drag triangular shaped rider configuration of the clubhead soleplate (20). The low-drag triangular rider is highly effective in the high rough grass sections of golf courses. Both features significantly improve the playability of the present invention over all other existing state-of-the-art designs.

FIG. 21.—Is a front view that illustrates a down-hill terrain (21), a golf ball, and the innovated design features of the present invention clubhead soleplate that negates these difficult down-hill lies, and the single low-drag soleplate rider.

(h) Drawing 8/9—Optimum Dynamic Impact Irons Type Golf Club/Clubs #1–9, Pitching Wedge & Sand Wedge.—FIGS. 22–26.

The design of all irons is consistent with the basic Optimum Impact (Impulse) Dynamic golf club design philosophy—maximum mass at center of percussion, optimized mass distribution profile(s) to minimize effects of non-coincident center of percussion impacts, and integral centralized balance/control for precise control.

FIG. 22.—Is a rear view of the club that illustrates the concentration of optimized club mass at the center of percussion, computerized mass distribution profile, highly sensitive centralized balance/control mechanism ((22), and the blending of all surfaces to elliminate stress concentrations and discontinuities.

FIG. 23.—Is a frontal view that illustrates the clubhead geometric profile and center of percussion (CP).

FIG. 24.—Is an end view of the club that illustrates the concentration of optimized mass at the center of percussion, computerized mass distribution profile, contour and blending of the upper and lower surfaces to the concentrated mass, centralized balance/control system, and hosel off-set (23). Vernier balance mass wafers are omitted for clarity—See FIG. 27.

FIG. 25.—Is a plan view of the club that illustrates the concentration of optimized mass at the center of percussion, computerized mass distribution profile, contour and blending of heel and toe sections to the concentrated mass, blending of the concentrated mass at the critical toe/hosel section, high moments of inertia at all critical sections, and centralized balance/control mechanism.

FIG. 26.—Is an isometric view that illustrates the computerized mass distributuion profile, concentration of optimized mass at the center of percussion, smooth transition and blending of all surfaces to elliminate stress discontinuities and acquire high moments of inertia in all axes, and centralized balance/control mechanism.

(i) Drawing 9/9—Optimum Dynamic Impact Golf Club Integral Centralized Balance/Control Mechanisms.—FIGS. 27–31.

FIG. 27.—Is a detailed view of the present invention centralized balance/control mechanism that is common/typical for all the present invention golf club types, differences are limited to the diameter and length of the centralized control setscrew (24), and the magnitude of vernier balance mass wafers (25). The control setscrew and vernier mass wafers are manufactured from high density materials. The optimization of the control setscrew physical and material characteristics in conjunction with the optimized mass distribution of each clubhead provides exceedingly high and unprecedented levels of concentrated mass at the clubhead (s) center of percussion; the present invention precise micro-balance control mechanism is also unprecedented. The axes of the centralized balance/control mechanism and clubhead (s) center of percussion are coincident.

FIG. 28.—Is an end view of the present invention driver/fairway (woods) type of clubs and illustrates pictorially the physical location of the integral centralized balance/control mechanism and coincident center of percussion.

FIG. 29.—Is an end view of the present invention iron type golf club and illustrates pictorially the physical location of the integral centralized balance/control mechanism and coincident center of percussion.

FIG. 30.—Is an end view of the present invention putter (mallet) type golf club and illustrates pictorially the physical location of the integral centralized balance/control mechanism and coincident center of percussion.

FIG. 31.—Is an end view of the present invention putter (blade) type golf club and illustrates pictorially the physical location of the integral centralized balance/control mechanism and coincident center of percussion.

It will be apparent to those skilled in the art that various modifications and variations can be made in the golf heads of the present invention and in construction of these golf heads without departing from the spirit of the invention. Other embodiments of the invention will be apparent to those skilled in the art from consideration of the specification and practise of the invention disclosed herein. It is intended that the specification and examples be considered as exemplary only, with a true scope and spirit of the invention being indicated by the following claims.

I claim:

1. An driver/fairway club(s) (woods) type golf clubhead for hitting a golf ball comprising:

(a) a golf clubhead body having a heel section, a toe section, a mass optimized double sculptured bottom sole with single triangular-shaped rider, a upper double curvature aerodynamic wing surface, a lofted ball striking faceplate with a double curvature external surface and mass distribution controlled internal surface, a centralized mass optimized angular momentum control member, a centralized balance/control mechanism, and low density-high damping shock/vibration system;

(b) a hosel adjacent said heel portion and said upper double curvature aerodynamic wing surface and having a front and rear surface, said rear surface smoothly transitions into the said heel portion of said clubhead body, and said front surface smoothly transitions into the external surface of the said aerodynamic wing;

(c) said clubhead body is of preferred all-metal (magnesium or other low density metal) construction with two centrally located cavities that are set-back from the said lofted ball striking faceplate and separated by the said mass optimized angular momentum control member that is located at the clubhead center of percussion and houses the centralized balance/control mechanism, said cavities are filled with said low density-high damping material;

(d) said clubhead body toe section extends beyond and smoothly transitions into the said lofted ball striking faceplate, the overhanging leading edge of the said double curvature aerodynamic wing, and said double sculptured bottom sole surfaces.

2. The driver/fairway clubs (woods) type clubhead of claim 1 wherein the said integral mass optimized angular momentum control member and internally housed centralized balance/control system axes are coincident with the clubhead center of percussion and smoothly transition into the said lofted ball striking faceplate mass distribution controlled internal surface, and surfaces of the said double sculptured soleplate, said body structure, and said double curvature aerodynamic wing.

3. The driver/fairway clubs (woods) type clubhead of claim 1 wherein the said lofted ball striking faceplate with a double curvature external surface and mass distribution controlled internal surface is an integral part of the optimized clubhead mass distribution profile, and transitions smoothly into the mass optimized angular momentum control member, and surfaces of the said aerodynamic wing, said bottom sole, and said clubhead body.

4. The driver/fairway clubs (woods) type clubhead of claim 1 wherein the said centralized balance/control system is housed in the said mass optimized angular momentum control member and axes are coincident with clubhead center of percussion.

5. The driver/fairway clubs (woods) type clubhead of claim 1 wherein the said upper surface double curvature aerodynamic wing controls the aerodynamic profile of the said clubhead body, and leading edge of said upper surface double curvature aerodynamic wing has controlled overhang/extension beyond the perimeter of said clubhead body and transitions smoothly into the perimeter of said clubhead body, and said lofted ball striking surface.

6. The driver/fairway clubs (woods) type clubhead of claim 1 wherein the said mass optimized double sculptured bottom sole with low drag single triangular-shaped rider constitutes the base of the said clubhead.

7. The driver/fairway clubs (woods) type clubhead of claim 1 wherein the said toe portion of the said clubhead body extends beyond and smoothly transitions into the said lofted ball striking faceplate and surfaces of the said bottom sole, and said aerodynamic wing.

8. The driver/fairway clubs (woods) type clubhead of claim 1 wherein the said low density-high damping shock/vibratory system is an integral part of the clubhead and transitions smoothly into the said upper surface double curvature aerodynamic wing and constitutes the upper surface closure.

9. An driver/fairway club (woods) type golf clubhead for hitting a golf ball comprising:

(a) a golf clubhead body having a heel section, a toe section, a mass optimized double sculptured bottom sole with single triangular-shaped rider, a upper double curvature aerodynamic wing surface, a lofted ball striking faceplate with a double curvature external surface and mass distribution controlled internal surface, a centralized mass optimized angular momentum control member, a centralized balance/control mechanism, and low density-high damping shock/vibration system;

(b) a hosel adjacent said heel portion and said upper double curvature aerodynamic wing surface and having a front and rear surface, said rear surface smoothly transitions into the said heel portion of said clubhead body, and said front surface smoothly transitions into the external surface of the said aerodynamic wing;

(c) said clubhead body is of non-metal/metal-matrix composite material construction with two centrally located cavities that are set-back from the said lofted ball striking faceplate and separated by the said mass optimized angular momentum control member that is located at the clubhead center of percussion and houses the centralized balance/control mechanism, said cavities are filled with said low density-high damping material;

(d) said clubhead body toe section extends beyond and smoothly transitions into the said lofted ball striking faceplate, the overhanging leading edge of the said double curvature aerodynamic wing, and said double sculptured bottom sole surfaces.

10. The driver/fairway clubs (woods) type clubhead of claim 9 wherein the said integral mass optimized angular momentum control member and internally housed centralized balance/control system axes are coincident with the clubhead center of percussion and smoothly transition into the said lofted ball striking faceplate mass distribution controlled internal surface, and surfaces of the said double sculptured soleplate, said body structure, and said double curvature aerodynamic wing.

11. The driver/fairway clubs (woods) type clubhead of claim 9 wherein the said lofted ball striking faceplate is a metallic/non-metallic element with a double curvature external surface and mass distribution controlled internal surface is an integral part of the optimized clubhead mass distribution profile, and transitions smoothly into said mass optimized angular momentum control member, and surfaces of the said aerodynamic wing, said bottom sole, and said clubhead body.

12. The driver/fairway clubs (woods) type clubhead of claim 9 wherein the said centralized balance/control system is a metallic/non-metallic or combination thereof assembly housed within the said mass optimized angular momentum control member and axes coincident with clubhead center of percussion.

13. The driver/fairway clubs (woods) type clubhead of claim 9 wherein the said upper surface double curvature aerodynamic wing controls the aerodynamic profile of the said clubhead body, and leading edge of said upper surface double curvature aerodynamic wing has controlled overhang/extension beyond the perimeter of said clubhead body and transitions smoothly into the perimeter of said clubhead body, and said lofted ball striking surface.

14. The driver/fairway clubs (woods) type clubhead of claim 9 wherein the said mass optimized double sculptured bottom sole with low drag single triangular-shaped rider constitutes the base of the said clubhead.

15. The driver/fairway clubs (woods) type clubhead of claim 9 wherein the said toe portion of the said clubhead body extends beyond and smoothly transitions into the said lofted ball striking faceplate and surfaces of the said bottom sole, and said aerodynamic wing.

16. The driver/fairway clubs (woods) type clubhead of claim 9 wherein the said low density-high damping shock/vibratory system is an integral part of the clubhead and transitions smoothly into the said upper surface double curvature aerodynamic wing and constitutes the upper surface closure.

17. An driver/fairway club (woods) type golf clubhead for hitting a golf ball comprising:

(a) a golf clubhead body having a heel section, a toe section, a mass optimized double sculptured bottom sole with single triangular-shaped rider, a upper double curvature aerodynamic wing surface, a lofted ball striking faceplate with a double curvature external surface and mass distribution controlled internal surface, a centralized mass optimized angular momentum control member, and a centralized balance/control mechanism;

(b) a hosel adjacent said heel portion and said upper double curvature aerodynamic wing surface and having a front and rear surface, said rear surface smoothly transitions into the said heel portion of said clubhead body, and said front surface smoothly transitions into the external surface of the said aerodynamic wing;

(c) said clubhead body construction is a hollow metal/non-metallic/metal-matrix shell with internal bracing that includes the said mass optimized angular momentum control member that is coincident with the clubhead center of percussion and internally houses the centralized balance/control mechanism;

(d) said clubhead body toe section extends beyond and smoothly transitions into the said lofted ball striking faceplate, the overhanging leading edge of the said double curvature aerodynamic wing, and said double sculptured bottom sole surfaces.

18. The driver/fairway clubs (woods) type clubhead of claim 17 wherein the said integral mass optimized angular momentum control member and internally housed centralized balance/control system axes are coincident with the clubhead center of percussion and smoothly transition into the said lofted ball striking faceplate mass distribution controlled internal surface, and surfaces of the said double sculptured soleplate, said body structure, and said double curvature aerodynamic wing.

19. The driver/fairway clubs (woods) type clubhead of claim 17 wherein the said lofted ball striking faceplate is a metallic/non-metallic element with a double curvature external surface and mass distribution controlled internal surface is an integral part of the optimized clubhead mass coincident with the clubhead center of percussion and transitions smoothly into said mass optimized angular momentum control member, and surfaces of the said aerodynamic wing, said bottom sole, and said clubhead body.

20. The driver/fairway clubs (woods) type clubhead of claim 17 wherein the said centralized balance/control system is a metallic/non-metallic or combination thereof assembly housed within the said mass optimized angular momentum control member and axes coincident with clubhead center of percussion.

21. The driver/fairway clubs (woods) type clubhead of claim 17 wherein the said upper surface double curvature aerodynamic wing controls the aerodynamic profile of the said clubhead body, and leading edge of said upper surface double curvature aerodynamic wing has controlled overhang/extension beyond the perimeter of said clubhead body and transitions smoothly into the perimeter of said clubhead body, and said lofted ball striking surface.

22. The driver/fairway clubs (woods) type clubhead of claim 17 wherein the said mass optimized double sculptured bottom sole with low drag single triangular-shaped rider constitutes the base of the said clubhead.

23. The driver/fairway clubs (woods) type clubhead of claim 17 wherein the said toe portion of the said clubhead body extends beyond and smoothly transition into the said lofted ball striking faceplate and surfaces of the said bottom sole, and said aerodynamic wing.

24. The driver/fairway clubs (woods) type clubhead of claim 17 wherein the said low-density high damping shock/vibratory system is an integral part of the clubhead and transitions smoothly into the said upper surface double curvature aerodynamic wing and constitutes the upper surface closure.

* * * * *